US009108311B2

(12) United States Patent
Keskiniva et al.

(10) Patent No.: US 9,108,311 B2
(45) Date of Patent: Aug. 18, 2015

(54) PERCUSSION DEVICE

(75) Inventors: Markku Keskiniva, Ylöjärvi (FI); Juha Piispanen, Ylinen (FI); Mauri Esko, Ikaalinen (FI)

(73) Assignee: Sandvik Mining and Construction Oy, Tampere (FI)

( * ) Notice: Subject to any disclaimer, the term of this patent is extended or adjusted under 35 U.S.C. 154(b) by 795 days.

(21) Appl. No.: 13/259,793

(22) PCT Filed: Mar. 24, 2010

(86) PCT No.: PCT/FI2010/050231

§ 371 (c)(1),
(2), (4) Date: Sep. 23, 2011

(87) PCT Pub. No.: WO2010/109073

PCT Pub. Date: Sep. 30, 2010

(65) Prior Publication Data

US 2012/0018182 A1 Jan. 26, 2012

(30) Foreign Application Priority Data

Mar. 26, 2009 (FI) ..... 20095315

(51) Int. Cl.
*B25D 9/16* (2006.01)
*B25D 9/18* (2006.01)
(Continued)

(52) U.S. Cl.
CPC .. *B25D 9/18* (2013.01); *B25D 9/22* (2013.01); *B25D 17/245* (2013.01); *B25D 2209/005* (2013.01); *B25D 2217/0023* (2013.01)

(58) Field of Classification Search
CPC ..... B25D 9/22; B25D 9/125; B25D 17/245; B25D 9/145; B25D 9/18; B25D 2209/005; B25D 2209/007; E21B 1/00; E21B 4/14
USPC ..... 173/90, 200, 201, 204; 91/325, 327
See application file for complete search history.

(56) References Cited

U.S. PATENT DOCUMENTS 5,056,606 A * 10/1991 Barthomeuf ..... 173/13
5,134,989 A * 8/1992 Akahane ..... 125/40
(Continued)

FOREIGN PATENT DOCUMENTS

FR 2 268 602 11/1975
GB 2 008 187 5/1979
(Continued)

OTHER PUBLICATIONS

English translation of Notice of Grounds for Rejection for Korean Patent Application No. 2011-7025101, dated Jun. 27, 2013.
(Continued)

*Primary Examiner* — Andrew M Tecco
(74) *Attorney, Agent, or Firm* — Morgan, Lewis & Bockius LLP

(57) ABSTRACT

The invention relates to a percussion device having a frame, a tool mounted movable in its longitudinal direction, the percussion device containing a work chamber having a movably mounted transmission piston to compress the tool so that a longitudinal stress pulse is generated to the tool, inlet and outlet channels for conducting the pressure fluid to the percussion device and away from it and a control valve that alternately directs the pressure fluid from the inlet channel to the work chamber to act on the transmission piston and, correspondingly, discharges the pressure fluid from the percussion device. The percussion device and trans-mission piston have channels that connect the pressure fluid that acted on the transmission piston to flow during the return movement of the transmission piston through the control valve and trans-mission piston to the pressure fluid outlet channel and cut off the flow when the transmission piston has returned to its initial position.

19 Claims, 4 Drawing Sheets

(51) Int. Cl.
*B25D 9/22* (2006.01)
*B25D 17/24* (2006.01)

(56) References Cited

U.S. PATENT DOCUMENTS

| | | | | |
|---|---|---|---|---|
| 5,884,713 | A * | 3/1999 | Shinohara et al. | 173/206 |
| 6,029,753 | A * | 2/2000 | Kuusento et al. | 173/1 |
| 7,234,548 | B2 * | 6/2007 | Comarmond | 175/296 |
| 7,290,622 | B2 * | 11/2007 | Keskiniva et al. | 173/91 |
| 7,322,425 | B2 * | 1/2008 | Keskiniva et al. | 173/1 |
| 7,836,969 | B2 * | 11/2010 | Ahola et al. | 173/1 |
| 7,878,263 | B2 * | 2/2011 | Keskiniva et al. | 173/90 |
| 8,151,901 | B2 * | 4/2012 | Keskiniva et al. | 173/90 |
| 8,800,425 | B2 * | 8/2014 | Koskimaki et al. | 91/299 |
| 2005/0016774 | A1 * | 1/2005 | Comarmond | 175/296 |
| 2006/0032649 | A1 * | 2/2006 | Keskiniva et al. | 173/213 |
| 2006/0157259 | A1 * | 7/2006 | Keskiniva et al. | 173/1 |
| 2006/0185864 | A1 | 8/2006 | Keskiniva et al. | |
| 2010/0059242 | A1 * | 3/2010 | Koskimaki et al. | 173/201 |

FOREIGN PATENT DOCUMENTS

| | | |
|---|---|---|
| GB | 1 478 435 | 6/1997 |
| JP | 2008-526534 | 7/2008 |
| WO | WO 03/078107 | 9/2003 |
| WO | WO 2008/074920 | 6/2008 |

OTHER PUBLICATIONS

Extended European Search Report for European Patent Application No. 10755489.1, dated Aug. 21, 2013.
International Search Report and written opinion in PCT Application No. for PCT/FI2010/050231 dated Jun. 14, 2010.
Search Report in Finish Application No. 20095315 dated Feb. 4, 2010.

* cited by examiner

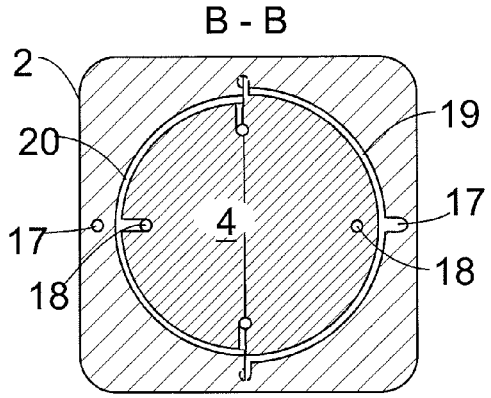
Fig. 5
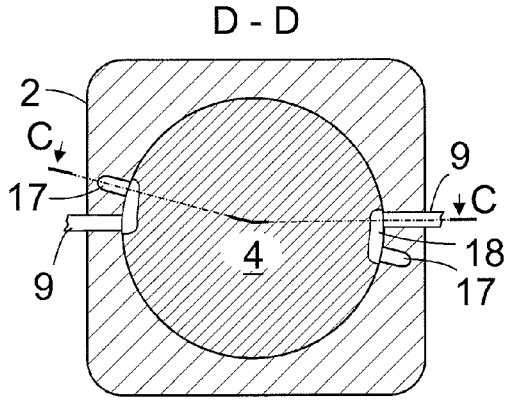
Fig. 6
Fig.7
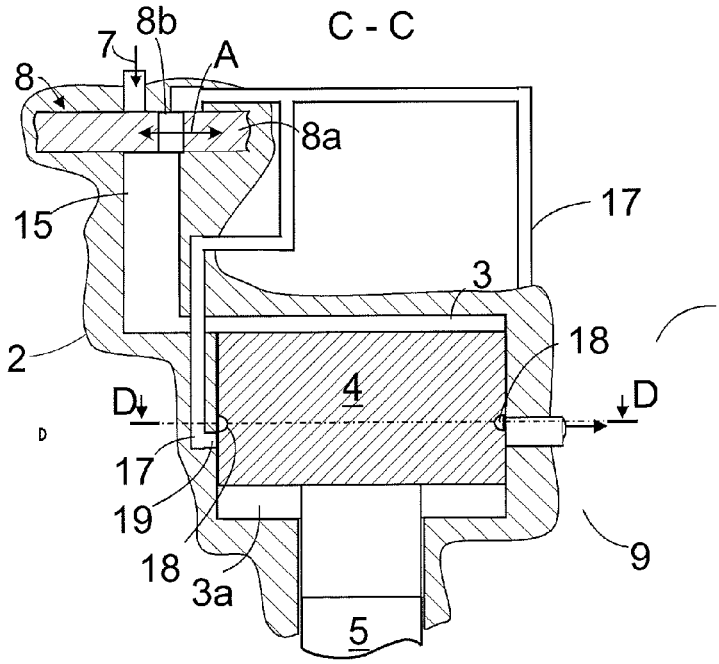

PERCUSSION DEVICE

CROSS REFERENCE TO RELATED APPLICATIONS

This application is the National Stage of International Application No. PCT/FI2010/050231, filed Mar. 24, 2010, and claims benefit of Finnish Application No. 20095315, filed Mar. 26, 2009, both of which are herein incorporated by reference in their entirety.

BACKGROUND OF THE INVENTION

The invention relates to a percussion device having a frame, to which a tool is mountable movable in its longitudinal direction relative to the frame of the percussion device, the percussion device containing a work chamber having a transmission piston mounted movable in the axial direction of the tool to compress the tool suddenly in its longitudinal direction by the pressure of the pressure fluid acting on the transmission piston to generate a longitudinal stress pulse to the tool, which propagates through the tool to the material being crushed, inlet and outlet channels for conducting the pressure fluid to the percussion device and away from it and a control valve that has a movably mounted switch member with at least one channel so that the switch member supplies pressure fluid alternately from the inlet channel to the work chamber to act on the transmission piston, whereby the transmission piston moves in relation to the frame of the percussion device toward the tool and, correspondingly, to discharge the pressure fluid that acted on the transmission piston from the percussion device, whereby during its return movement the transmission piston moves in relation to the frame of the percussion device back to its initial position.

In the percussion device of the invention, a stress pulse is provided by arranging the pressure of pressure fluid to act on a transmission piston in a separate work chamber preferably relatively suddenly. The pressure effect pushes the transmission piston toward the tool. As a result of this, the tool is compressed, whereby a stress pulse is formed in the tool to run through the tool and, when the tool bit is in contact with rock or some other targeted hard material, to break it. In the percussion device, it is possible to use to control its percussion operation a rotating or linearly reciprocating switch member that typically has consecutive openings that alternately open a connection from a pressure fluid source to the transmission piston of the percussion device and, correspondingly, from the transmission piston to the pressure fluid container. A general problem with known solutions is the return of the piston to its initial position, which is, however, necessary to produce a continuous percussion operation. The easiest solution is to stop the transmission piston in the return direction by means of different mechanical limiters, such as shoulders. However, in solutions in which the transmission piston could rotate around its axis, this would cause friction and wear. Another problem is that when the transmission piston contacts the limiter, it is possible that material deformation and breakage result in the long run.

BRIEF DESCRIPTION OF THE INVENTION

It is an object of the invention to provide a percussion device, with which the transmission piston may be stopped at a required location reliably without mechanical limiters. The percussion device of the invention is characterised in that it has a first control channel leading to the location of the transmission piston or a part connected to and moving along with the transmission piston, the switch member of the control valve has at least one channel that connects the pressure fluid that acted on the transmission piston to flow during the return movement of the transmission piston through the control valve to the first control channel, and the transmission piston or the part connected to and moving along with the transmission piston has a second control channel that, when the transmission piston has moved from its initial position toward the tool, connects the first control channel to the outlet channel of the pressure fluid so that after the stress pulse has formed, during the return movement of the transmission piston, the pressure fluid that acted on the transmission piston is allowed to flow through the first and second control channels to the outlet channel and that said connection closes when the transmission piston has returned to its initial position, whereby the pressure fluid that remains in the work chamber forms a damping pillow that stops the return movement of the transmission piston to its initial position.

The invention provides the advantage that the return movement of the transmission piston is flexibly and reliably limited to the damping pillow formed by the pressure fluid without mechanical limiters. This way, the reliability of the percussion device improves. In addition, the solution is easy to implement by using pressure fluid channels only.

BRIEF DESCRIPTION OF FIGURES

The invention will be described in greater detail in the attached drawings, in which

FIG. 5 shows a section along line B-B of FIG. 4,

FIG. 6 shows a section along line D-D of FIG. 7,

FIG. 7 shows a section along line C-C of FIG. 6,

DETAILED DESCRIPTION OF THE INVENTION

Figure 1:
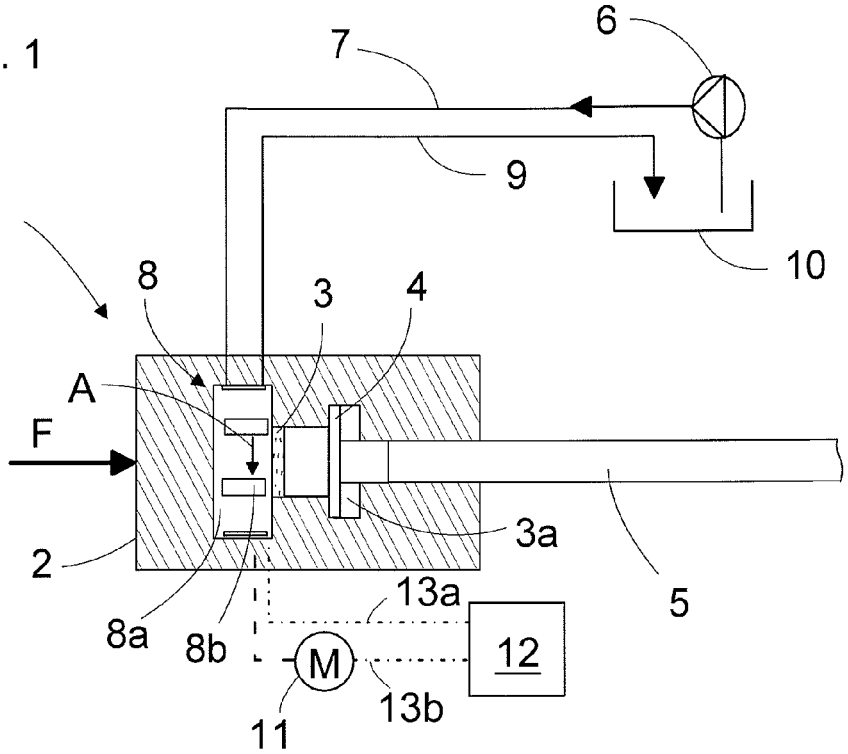
FIG. 1 is a schematic representation of the prior-art principle of the percussion device.

FIG. 1 is a schematic sectional view of a prior-art percussion device 1 with a frame 2, inside which there is a work chamber 3 and inside the work chamber 3 a transmission piston 4. The transmission piston 4 is coaxial with a tool 5 and they may move axially so that the transmission piston 4 touches the tool 5 directly at least when the stress pulse begins to form and during its formation or indirectly through a shank fastened to the tool and known per se. On the side of the transmission piston 4 opposite to the tool, there is a pressure surface facing the work chamber 3. For forming the stress pulse, pressurized pressure fluid is led from a pressure source, such as a pump 6, along an inlet channel 7 through a control valve 8 to the work chamber 3. The control valve has a moving switch member 8*a* with one or, as shown in the figure, several channels, such as openings or grooves 8*b*. As the switch member 8*a* of the control valve 8 moves, the pressure fluid acts on the transmission piston 4 through the openings or grooves 8*b* and, correspondingly, as the switch member 8*a* continues to move, the pressure of the pressure fluid that acted on the transmission piston 4 discharges through an outlet channel 9. A stress pulse is formed when the pressure fluid pressure pushes the transmission piston 4 toward the tool 5 and through this compresses the tool 5 against the material being crushed. As it moves through the tool's 5 tip, such as a drill bit, to the material being crushed, such as rock, in a manner known per se, the stress pulse breaks the material. When the switch member of the control valve 8 prevents the pressure fluid from entering the percussion device and then allows the pressure fluid that acted on the transmission piston 4 to discharge through the outlet channel 9 to a pressure fluid container 10, the stress pulse stops, and the transmission piston 4 that moved a short distance, only a few millimeters, toward the tool 5, is allowed to return to its initial position. This is repeated as the switch member 8*a* of the valve 8 moves and alternately switches the pressure to act on the transmission piston and then allows the pressure to discharge, whereby, as the switch member 8*a* moves continuously, a series of consecutive stress pulses is formed.

During the use of the percussion device, it is pushed in a manner known per se by using a feed force F toward the tool 5 and, at the same time, toward the material being crushed. To return the transmission piston 4, pressure medium may be supplied to the chamber 3*a* as necessary between stress pulses or the transmission piston may be returned by mechanical means, such as spring, or by pushing the percussion device with the feed force in the drilling direction, whereby the transmission piston moves backward in relation the percussion device, that is, to its initial position. The tool may be a part that is separate from the piston or integrated to it in a manner known per se.

In the case of FIG. 1, the control valve 8 has a rotatably moving switch member 8*a* coaxial with the tool 5, which is rotated around its axis in the direction of arrow A by using a suitable rotating mechanism, such as a motor 11, by means of power transmission shown schematically by a dashed line. Alternatively, the switch member 8*a* is turned rotatably back and forth using a suitable mechanism. A rotatably moving switch member may also be mounted otherwise, for instance on the frame 2 on the side of the work chamber 3. A reciprocating switch member may also be used in the control valve 8 instead of a rotatably moving switch member. Further, it is possible to use in all cases a control valve, whose switch member has only one channel to conduct the pressure fluid toward the work chamber and, correspondingly, away from it. However, the switch member 8*a* of the control valve 8 preferably has several parallel channels.

FIG. 1 further shows a control unit 12 that may be connected to control the rotating speed of the control valve or the rate of movement of the reciprocating control valve by means of control channels or signal lines 13*a* and 13*b*. This type of adjustment may be implemented by several different techniques known per se by using desired parameters, such as drilling conditions, the hardness of the stone being crushed, for instance.

Figure 2:
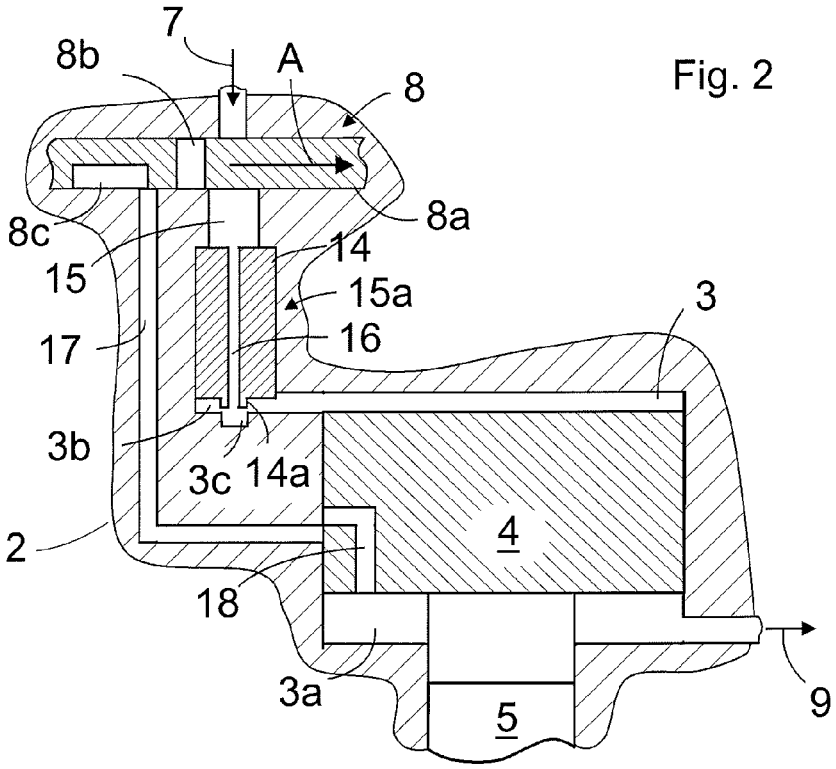
FIG. 2 is a schematic view of an embodiment of the invention.

FIG. 2 is a schematic view of an embodiment of the invention, It shows only part of the control valve 8 equipped with a moving switch member 8*a* and the frame 2 of the percussion device. It has between the control valve 8 and transmission piston 4 a separate closure member 14 that moves in a valve space 15*a* in the pressure fluid channel between the control valve 8 and transmission piston 4. A stress pulse is formed in such a manner that the pressurized pressure fluid is directed by means of the control valve 8 to flow toward the transmission valve 4, whereby the closure member moves substantially along with the flow in the channel. In this situation and on both sides of the closure member, substantially the same pressure prevails. As a result of this, the transmission piston 4 moves toward the tool 5 and compresses it and, consequently, a stress pulse is formed in the tool. The formation of the stress pulse continues until the closure member 14 stops at a barrier that mechanically limits its movement and, at the same time, cuts off the flow of the pressure fluid toward the transmission piston 4. It is thus possible to adjust the length of the stress pulse by altering the length of movement of the closure member 14.

After the formation of the stress pulse, the switch member 8*a* of the control valve, when moving, opens a connection from the pressure fluid channel between the control valve 8 and transmission piston 4 to the pressure fluid return channel 9 and the pressure is released and, as the transmission piston 4 moves back to its initial position under the effect of the return force, the closure member 14 correspondingly goes back to its initial position.

In practice, it is necessary that the pressure fluid in the work chamber of the transmission piston 4 is allowed to change, because otherwise it will heat up too much. Similarly, one should take into account the fact that in this type of solution, some oil leaks always occur regardless of the sealings. In the solution of FIG. 2, these matters have been taken into account. In it, a channel 16 runs through the closure member 14, an opening of which is in a projection 14*a* and through which a small amount of pressure fluid is allowed to flow from the pressure fluid channel 15 to the work chamber 3, when the valve 8 connects the pressure fluid to act on the closure member 14. The amount of pressure fluid that flows through the channel 16 is quite small in volume. As the stress pulse propagates when the closure member 14 moves toward the pressure fluid space 3*b*, the projection 14*a* at the front end of the closure member on the pressure fluid space 3*b* side pushes into a recess 3*c*, which corresponds to it in shape and size, and prevents the flow of the pressure fluid from the channel 16 to the pressure fluid space 3*b*. When the stress pulse is formed, the transmission piston 4 and closure member 14 return to their initial positions in the manner described earlier, whereby the extra pressure fluid that flowed into the pressure fluid space 3*b* and thus also to the work chamber 3 exits again through the channel 16.

In the embodiment shown in FIG. 2, the percussion piston is returned to its initial position by utilising the feed force of the percussion device, whereby the feed force moves the percussion device forward and the transmission piston supported on the tool 5 remains stationary while the frame of the percussion device pushes toward the tool 5. In this case, the pressure fluid space 3*a* in front of the transmission piston 4 is connected to the pressure fluid container through the channel 9 without pressure.

The switch member 8*a* of the control valve 8, in turn, has a groove or the like 8*c* that connects the pressure fluid channel 15 between the closure member 14 and control valve 8 to a first control channel 17. The transmission piston 4, in turn, has an inner second control channel 18 that opens a connection between the pressure fluid space 3*a* and the first control channel 17 when the transmission piston 4 moves toward the tool 5 during the formation of the stress pulse. When the transmission piston 4 is pushed relative to the frame 2 of the percussion device 1 back to its initial position, the pressure fluid flows from the work chamber 3 and first pushes the closure member 14 backward and then flows through the channel 16 of the closure member 14 to the pressure fluid channel 15 and through the groove or the like 8*c* to the first control channel 17 and on through the second control channel 18 to the pressure fluid space 3*a*. When the transmission piston 4 has moved to its initial position, that is, to the position shown in FIG. 2, the connection between the channels 17 and 18 has closed and the pressure fluid no longer flows out from the work chamber 3. The transmission piston 4 is then stopped hydraulically to its initial position and the pressure fluid in a closed space dampens and stops the movement of the transmission piston 4 softly without significant mechanical strains.

Figure 3:
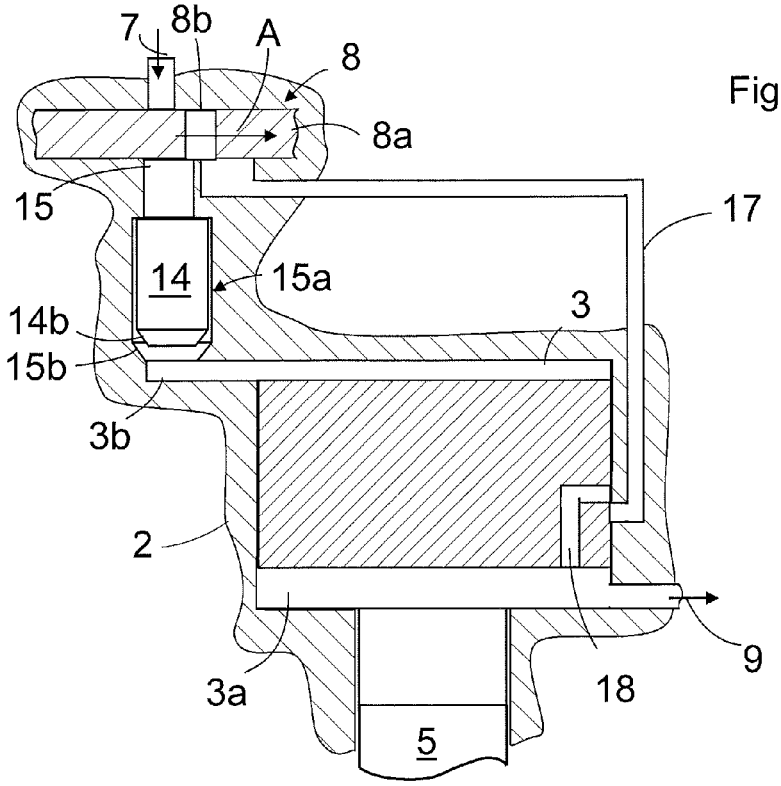
FIG. 3 is a schematic view of a second embodiment of the invention.

FIG. 3 is a schematic view of a second embodiment of the invention. A closure member 14 having a smaller cross-section than that of the surrounding valve space 15*a* is used in it. Therefore, both during the supply of the pressure fluid and during the return flow, the pressure fluid can flow in them through the gap between the closure member 14 and valve space 15*a*. In this embodiment, the flow of the pressure fluid ends when a conical or curved, for instance spherical, surface 14*b* of the closure member contacts a conical or concave sealing surface 15*b* at the end of the valve space 15*a*. The limiting of the movement of the transmission piston 4 takes place otherwise as in FIG. 2, but the return flow is controlled by the openings or grooves 8*b* of the switch member 8*a* of the control valve 8, which connect the pressure fluid channel 15 to the first control channel 17 for the duration of the return movement of the transmission piston 4.

Figure 4:
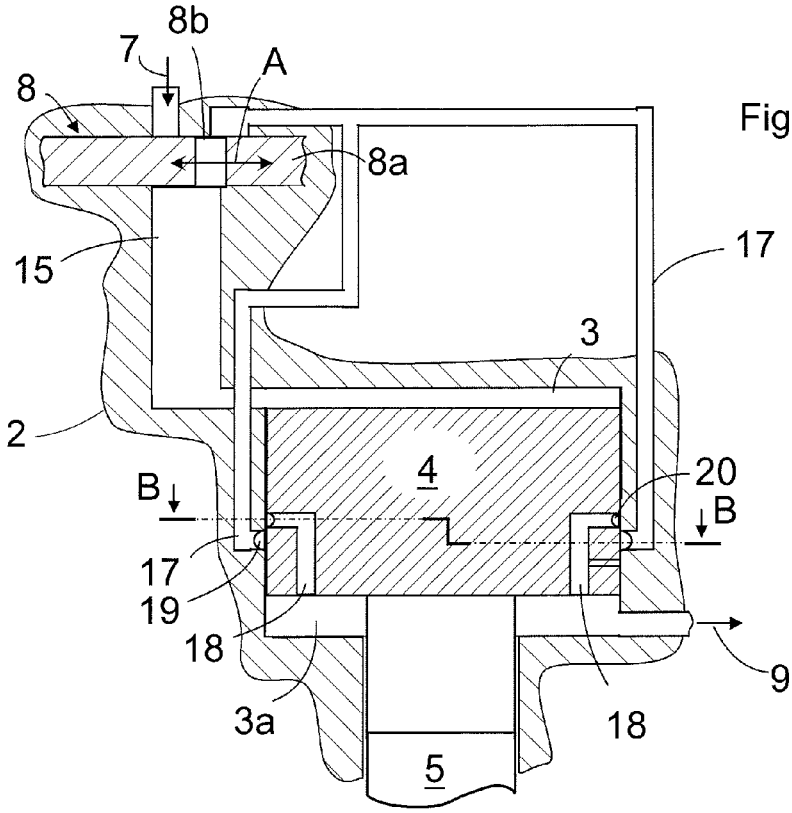
FIG. 4 shows yet another embodiment of the invention.

FIG. 4 is a schematic view of yet another embodiment of the invention. In it, arrow A indicates that the switch member 8*a* of the control valve may also move back and forth and not only rotatably in one direction. Further, it does not have closure members, but the pressure fluid is directed from the switch member 8*a* of the control valve 8 directly through the pressure fluid channel 15 to the work chamber 3. The limiting of the movement of the transmission piston 4 takes place as in FIGS. 2 and 3, but the return flow is controlled by the openings 8*b* of the switch member 8*a* of the control valve 8, which connect the pressure fluid channel 15 to the first control channel 17 on the opposite side of the switch member 8*a* for the duration of the return movement of the transmission piston 4. FIG. 4 shows two first control channels 17 and 18, respectively, but there may also be more than that, as shown in FIG. 5. It shows four channels 17 and 18, respectively, but their number may be selected as required by the operation.

Both FIG. 4 and FIG. 5 also show as an alternative embodiment annular grooves 19 and 20 that are formed on the surface of a cylinder space in the frame 2 or correspondingly in the transmission piston 4 and that connect the first and second control channels 17 and 18, respectively, to each other. There may also be only one annular groove, that is, on the cylinder space wall of the frame 2 or in the transmission piston 4. In all cases that have at least one annular groove, the number of channels 17 and 18 may be unequal. In these embodiments, the flow of the pressure fluid ends, when the bottom and top edges of the grooves 20 and 19 come together, or, when using only one groove, the edge of the groove and those of the channels of the other side come together.

FIG. 6 shows a section along line D-D of FIG. 7, and FIG. 7 shows a section along line C-C in FIG. 6. In the embodiment shown in them, the second control channel 18 is a groove on the side of the transmission piston 4, which connects the first control channel 17 and the outlet channel 9 leading to the inner surface of the cylinder space of the frame 2. The outlet channel 9 or alternatively the second control channel 18 at the outlet channel 9 has in the axial direction of the transmission piston 4 a length that allows the pressure fluid to flow the entire time that the first and second control channels are connected to each other.

Figure 8:
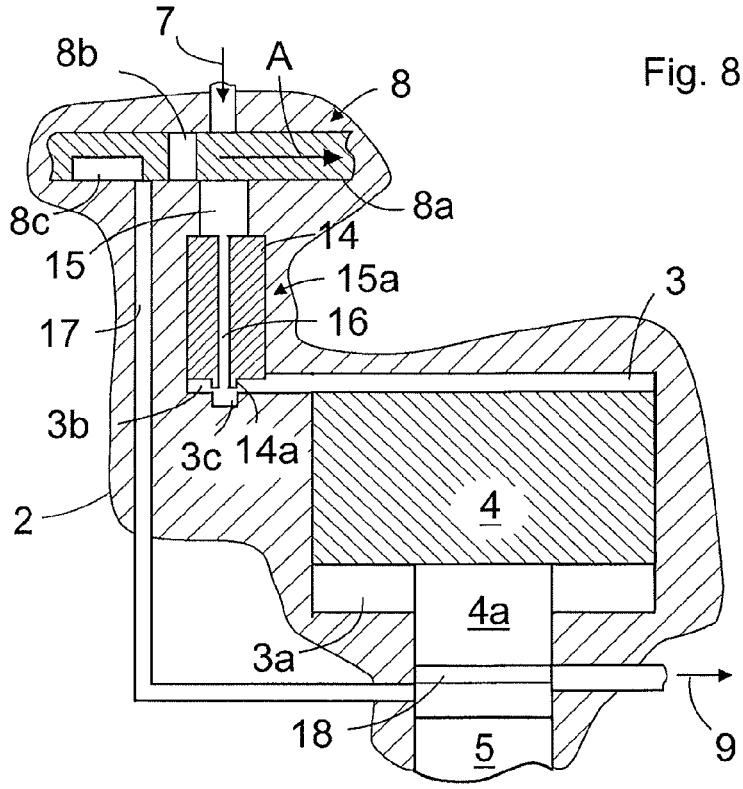
FIG. 8 is a schematic view of yet another embodiment of the invention.

FIG. 8 is a schematic view of yet another embodiment of the invention. It shows, as in FIG. 2, only part of the control valve 8 equipped with a moving switch member 8*a* and the frame 2 of the percussion device. Instead of determining the position of the transmission piston 4 by means of the second control channel in the transmission piston 4, in this embodiment, the second control channel 18 controlling the position of the transmission piston is formed in the part 4*a* that is an extension of the transmission piston 4 transmitting the compression force thereof to the tool, and the channels 9 and 17 are correspondingly connected to it. The operation of this embodiment corresponds to that of the other embodiments, and the details presented in the other embodiments may also be applied to this embodiment in a corresponding manner.

Figure 9:
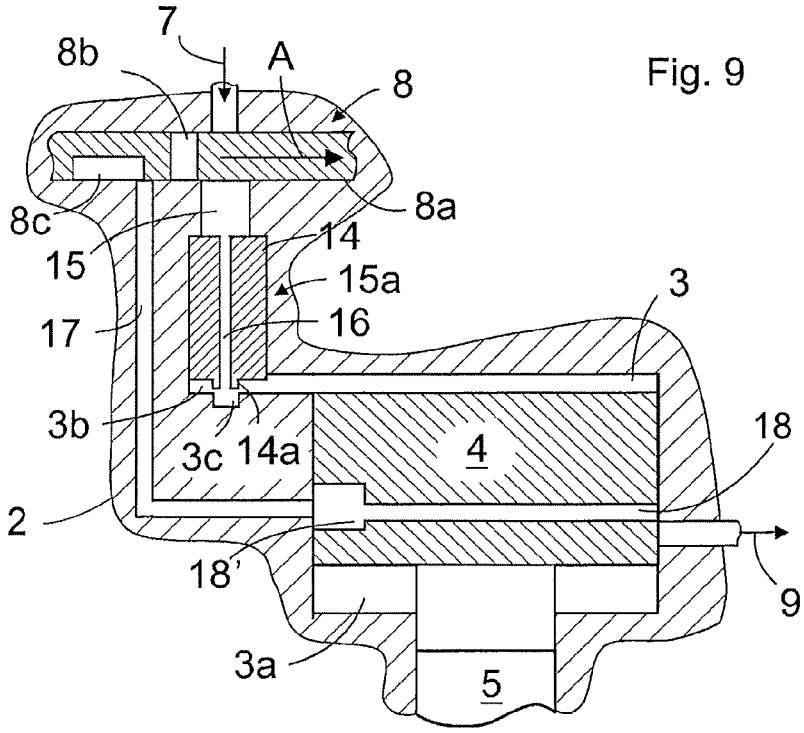
FIG. 9 is a schematic view of yet another embodiment of the invention.

FIG. 9 is a schematic view of yet another embodiment of the invention. In it, the second control channel 18 has in the direction of movement of the transmission piston a wider channel part 18' that maintains an open connection to the first control channel 17 along the entire length of movement of the transmission piston 4. Correspondingly, this type of wider part might be formed in the first control channel 17 or both. Further, to control the position of the transmission piston 4, the positions of the second control channel 18 and the outlet channel 9 are dimensioned in it in such a manner that the connection from the second control channel 18 to the outlet channel 9 closes, when the transmission piston 4 has returned into its initial position. This same solution may naturally also be applied to the case of FIG. 8.

Above, the invention is described in the specification and drawings by way of example only and it is in no way limited to the description. Different details of embodiments may be implemented in different ways and they may also be combined with each other. Thus, details in different figures, FIGS. 1 to 9, may be combined with each other in different manners to obtain the required embodiments in practice. The rotation or reciprocal movement of the switch member 8*a* of the control valve 8 may be implemented in any manner known per se mechanically, electrically, pneumatically or hydraulically. The switch member 8*a* of the control 8 valve may in all embodiments operate either rotatably in one direction or with a reciprocating movement. Even though the control valve having a rotating switch member 8*a* has, by way of example, been presented in a form, in which it has a cylindrical valve part, it may also correspondingly be implemented in a disc-like or conical form or in any corresponding form. Further, instead of the openings running through the switch member 8*a* of the control valve, it is also possible to use groove-like channels formed on the switch member 8*a*.

The invention claimed is:

1. A percussion device having a frame, to which a tool is mountable movable in its longitudinal direction relative to the frame of the percussion device, the percussion device containing a work chamber having a transmission piston mounted movable in the axial direction of the tool to compress the tool suddenly in its longitudinal direction by the pressure of the pressure fluid acting on the transmission piston to generate a longitudinal stress pulse to the tool, which propagates through the tool to a material being crushed, inlet and outlet channels for conducting the pressure fluid to the percussion device and away from it and a control valve that has a movably mounted switch member with one a first channel so that the switch member supplies pressure fluid alternately from the inlet channel to the work chamber to act on the transmission piston, whereby the transmission piston moves in relation to the frame of the percussion device toward the tool and, correspondingly, to discharge the pressure fluid that acted on the transmission piston from the percussion device, whereby during its return movement the transmission piston moves in relation to the frame of the percussion device back to its initial position, wherein a first control channel leads to a side of the transmission piston or a part connected to and moving along with the transmission piston, the switch member of the control valve has at one a second channel that connects the pressure fluid that acted on the transmission piston to flow during the return movement of the transmission piston through the control valve to the first control channel, and the transmission piston or the part connected to and moving along with the transmission piston has a second control channel that, when the transmission piston has moved from its initial position toward the tool, connects the first control channel to the outlet channel of the pressure fluid so that after the stress pulse has formed, during the return movement of the transmission piston, the pressure fluid that acted on the transmission piston is allowed to flow through the first and second control channels to the outlet channel and that said connection closes when the transmission piston has returned to its initial position, whereby the pressure fluid that remains in the work chamber forms a damping pillow that stops the return movement of the transmission piston to its initial position.

2. A percussion device as claimed in claim 1, wherein there are several first control channels and, correspondingly, second control channels.

3. A percussion device as claimed in claim 1, wherein the second control channel is arranged to run from the side of the transmission piston to a tool side space that is connected to the pressure fluid outlet channel.

4. A percussion device as claimed in claim 1, wherein the second control channel is a groove on the side of the transmission piston or a part connected to and moving along with the transmission piston and that the outlet channel is led to the location of the second control channel in the frame of the percussion device.

5. A percussion device as claimed in claim 1, wherein the second control channel is a channel formed through the transmission piston or the part connected to and moving along with the transmission piston and that the outlet channel is led in the frame of the percussion device to the opposite end of the second control channel with respect to the first control channel.

6. A percussion device as claimed in claim 1, wherein the first control channels are connected to each other by an annular groove formed on the frame of the percussion device.

7. A percussion device as claimed in claim 1, wherein the second control channels are connected to each other by an annular groove formed on the transmission piston or the part connected to and moving along with the transmission piston.

8. A percussion device as claimed in claim 2, wherein the second control channel is arranged to run from the side of the transmission piston to the tool side space that is connected to the pressure fluid outlet channel.

9. A percussion device as claimed in claim 2, wherein the second control channel is a groove on the side of the transmission piston or a part connected to and moving along with the transmission piston and that the outlet channel is led to the location of the second control channel in the frame of the percussion device.

10. A percussion device as claimed in claim 2, wherein the second control channel is a channel formed through the transmission piston or the part connected to and moving along with the transmission piston and that the outlet channel is led in the frame of the percussion device to the opposite end of the second control channel with respect to the first control channel.

11. A percussion device as claimed in claim 2, wherein the first control channels are connected to each other by an annular groove formed on the frame of the percussion device.

12. A percussion device as claimed in claim 3, wherein the first control channels are connected to each other by an annular groove formed on the frame of the percussion device.

13. A percussion device as claimed in claim 4, wherein the first control channels are connected to each other by an annular groove formed on the frame of the percussion device.

14. A percussion device as claimed in claim 5, wherein the first control channels are connected to each other by an annular groove formed on the frame of the percussion device.

15. A percussion device as claimed in claim 2, wherein the second control channels are connected to each other by an annular groove formed on the transmission piston or the part connected to and moving along with the transmission piston.

16. A percussion device as claimed in claim 3, wherein the second control channels are connected to each other by an annular groove formed on the transmission piston or the part connected to and moving along with the transmission piston.

17. A percussion device as claimed in claim 4, wherein the second control channels are connected to each other by an annular groove formed on the transmission piston or the part connected to and moving along with the transmission piston.

18. A percussion device as claimed in claim 5, wherein the second control channels are connected to each other by an annular groove formed on the transmission piston or the part connected to and moving along with the transmission piston.

19. A percussion device as claimed in claim 6, wherein the second control channels are connected to each other by an annular groove formed on the transmission piston or the part connected to and moving along with the transmission piston.

* * * * *